United States Patent [19]

Gransell et al.

[11] 4,194,922

[45] Mar. 25, 1980

[54] METHOD AND APPARATUS FOR ULTRASONIC CLEANING OF COMPONENT PARTS

[75] Inventors: Åke Gransell; Sven A. Jansson; Malte Sporrong, all of Nynäshamn, Sweden

[73] Assignee: Rederiaktiebolaget Nordstjernan, Stockholm, Sweden

[21] Appl. No.: 897,018

[22] Filed: Apr. 17, 1978

[30] Foreign Application Priority Data

Apr. 18, 1977 [SE] Sweden ..... 7704420

[51] Int. Cl.[2] ..... B08B 3/12

[52] U.S. Cl. ..... 134/1; 134/184; 198/727; 198/769; 366/109; 366/127

[58] Field of Search ..... 134/1, 184, 126, 127, 134/25 R; 366/109, 127; 198/727, 769

[56] References Cited

U.S. PATENT DOCUMENTS

| | | | |
|---|---|---|---|
| 1,820,676 | 8/1931 | Pickop | 366/109 |
| 2,724,393 | 11/1955 | Heise | 134/184 X |
| 2,784,119 | 3/1957 | McCown et al. | 134/127 X |
| 2,894,860 | 7/1959 | Engelhardt | 134/1 |
| 3,222,221 | 12/1965 | Branson | 134/1 |
| 3,301,535 | 1/1967 | Brown | 134/184 X |
| 3,329,408 | 7/1967 | Branson | 366/114 |
| 3,399,869 | 9/1968 | Loria | 134/184 X |
| 3,468,410 | 9/1969 | Kelley | 198/727 |
| 3,558,105 | 1/1971 | Moritz | 366/109 |
| 3,573,983 | 4/1971 | Antoneuich | 134/1 |
| 3,575,983 | 4/1971 | Coleman | 134/184 X |
| 3,730,489 | 5/1973 | Morita | 134/1 X |
| 3,985,344 | 10/1976 | McCord | 366/127 |
| 4,045,243 | 8/1977 | Wholert | 134/1 |
| 4,057,070 | 11/1977 | Van Amerongen et al. | 134/184 X |

FOREIGN PATENT DOCUMENTS

| | | | |
|---|---|---|---|
| 1228492 | 11/1966 | Fed. Rep. of Germany | 134/1 |
| 2217395 | 1/1973 | Fed. Rep. of Germany . | |
| 2147143 | 3/1973 | Fed. Rep. of Germany . | |
| 1385750 | 2/1975 | United Kingdom | 134/184 |

*Primary Examiner*—Richard V. Fisher
*Attorney, Agent, or Firm*—Brumbaugh, Graves, Donohue & Raymond

[57] ABSTRACT

A vibratory cleaning apparatus applies ultrasonic energy to component parts or workpieces directly resting on a vibrator surface. The surface forms part of a conveying arrangement that moves the parts as they are cleaned. Conveyance of the parts during their vibratory cleaning provides control of the time of cleaning. In various embodiments, the conveying arrangement can be an inclined plate or surface which is the vibration imparting member, an endless conveyor through which vibrations are conducted, or a wiper driven across a vibratory plate to move the workpieces thereon. The cleaning apparatus is suitable for large scale cleaning of production line parts or individual work bench application. In preferred embodiments, a further conveying arrangement automatically delivers the parts from the bath in which the ultrasonic transducer is located.

22 Claims, 9 Drawing Figures

METHOD AND APPARATUS FOR ULTRASONIC CLEANING OF COMPONENT PARTS

BACKGROUND OF THE INVENTION

This invention comprises a method and an apparatus for cleaning with ultrasonic vibratory energy. The invention is especially suitable for cleaning, with ultrasonic vibrations or energy, mass produced parts such as screws, nuts, bolts and similar fasteners, ballbearings, machine parts, parts for instruments, watches and other precision products.

The need for cleaning often exists at the end of a production line to remove fats, oils, dirt, carbon particles, soot, metal particles, oxides, etc. Also, within a production cycle there are needs for cleaning of component parts such as, for instance, those which in a later production step will go through electrolytic surface coating. Different apparatuses on the market at the present time for cleaning of component parts using ultrasonic vibrations or energy are built for a liquid as a medium in which the component parts are immersed during the cleaning. In these apparatuses one utilizes the force that develops at the intermediary surface between a liquid and a solid body when an ultrasonic field is put through the liquid bath. This force is primarily the result of a very high acceleration of the sound at the transition from the liquid to the solid body. Solid body is for this purpose defined not only as the component part which is to be cleaned, but also as the particles of different kinds which are to be removed from the component part. Also, fats, oils and similar substances on the surfaces of component parts cause such acceleration forces. These forces are normally stronger than the forces that exist between the adhering particles and the component parts to be cleaned.

In many liquids there also develops cavitation in addition to the acceleration forces under the influence of an ultrasonic field. Cavitation generates air or gas bubbles at the intermediary surfaces between solid bodies and the liquids. The bubbles are exposed to very high pressures, often 100 times higher than the dynamic pressure of the ultrasonic field. This cavitation plays an important role also in the cleaning of component parts because of its explosion effect. Cavitation, however, is only at hand at relatively low frequencies of the ultrasonic field. It is also enhanced by those liquids which have the ability to dissolve gases. The cavitation effect has one disadvantage, namely that it highly corrodes most materials. This fact puts a limit on the time such component parts which are susceptible to corrosion can be exposed to the cleaning process. This is one of the problems this invention is meant to solve.

In the apparatuses for cleaning of component parts using ultrasonic which are on the market, the component parts to be cleaned are often placed in baskets which are moved through an ultrasonic field. A disadvantage of this method is that parts which are located in the shadow of other parts in the ultrasonic field receive significantly weaker ultrasonic power than those which are directly exposed to the ultrasonic energy. Other types of apparatuses contain a drum of perforated plate in which rotation of the drum tumbles the parts to better expose the parts to the ultrasonic energy. In a third type of apparatus, the parts sink vertically down in a liquid bath and pass through an ultrasonic field. All of these types of apparatuses have in common the fact that the ultrasonic energy reaches the particles to be cleaned from a liquid bath. The loss of ultrasonic energy is substantial in passage through the liquid bath, which means that the ultrasonic energy has to be generated by relatively high energy transducers, and has to be used in combination with long treatment times, in order to achieve the desired degree of cleaning.

SUMMARY OF THE INVENTION

It is intended that this invention shall result in a more efficient cleaning at lower energy levels and at a shorter treatment time. The means of achieving this are characterized by the fact that the parts to be cleaned are brought into mechanical contact with a free surface of one or more plates, discs, tubes, pipes or similar objects, located close to each other, and that on the opposite free surface is mounted at least one ultrasonic transducer. This is done as the parts are moved through a bath.

The invention will be further described in relation to the following exemplary embodiments and reference is made to the attached drawings.

DESCRIPTION OF PREFERRED EMBODIMENTS

Figure 1:
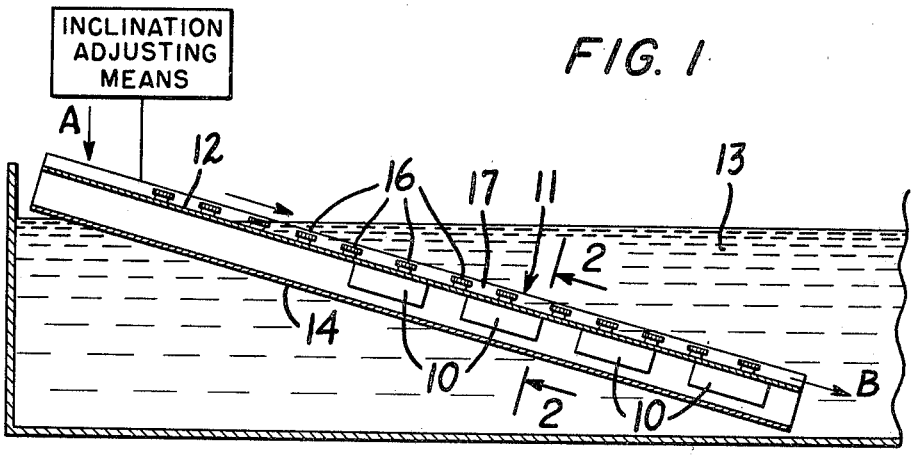
FIG. 1 is a diagrammatic illustration showing, in cross section, cleaning apparatus according to the invention.

FIG. 1 shows a cross-section of a device according to the invention. A series of ultrasonic vibration generating transducers 10 is mounted on the underside of a member or plate 12. This plate 12 can preferably be the bottom of an inclined channel or gutter 11 down which parts 16 to be cleaned slide. Two upright gutter sides 17 complete the gutter 11. The parts are fed into the gutter at location A in any suitable manner, and at location B the parts, now cleaned, are collected for discharge, again in a known manner. Parts 16 pass immediately over the ultrasonic transducers and in mechanical contact with these during a short period of time by virtue of the plate 12 being driven by the transducers 10 and forming the energy transmitting output member of these transducers, as discussed below. Time of contact can be adjusted by changing the angle of inclination of the plate 12. FIG. 1 illustrates, very generally and in block diagram form, inclination adjusting means; numerous arrangements for this purpose will be apparent. That part of the gutter or channel 11 along which the parts move and to which the ultrasonic transducers are mounted is immersed in a liquid bath 13, commonly water. The transducers 10 are water tight by virtue of the enclosure in a shell or housing 14.

Figure 2:
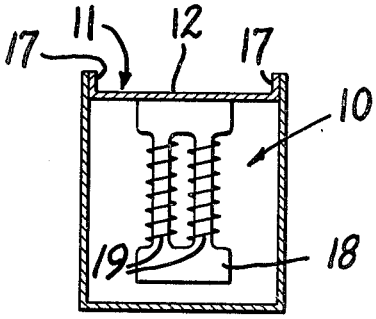
FIG. 2 is an enlarged diagrammatic illustration, in cross section along the line 2—2 of FIG. 1 showing a vibrator and vibratory plate or member that forms a part of a channel or gutter along which parts move as they are cleaned in a bath.

As shown diagrammatically in FIG. 2, the ultrasonic transducer 10 is mounted with its vibratory member 18 to the plate 12. For purposes of illustration only, the transducer 10 is shown as magnetostrictive with coils 19 and with a core that is the vibratory member 18. The transducer may be either magnetostrictive or piezoelectric. Both are known in the art. For the specific embodiments described with reference to FIGS. 7, 8 and 9 below, for example, piezoelectric transducers are preferred.

The plate 12 is both the bottom of the gutter 11 and the ultrasonic vibrator that imparts ultrasonic vibrations to the workpieces or parts 16 and to the surrounding bath. Good contact between the vibratory member 18 of the transducer 10 and the plate 12 results in a high transfer of energy with low losses. Plate 12 should be made of fairly thin sheet. For example, at a thickness of one millimeter of this plate, about 85% of the energy that is fed to the plate will leave its upper side. If the plate, however, is five millimeters thick, then only 20% of the energy applied to the plate will be passed therethrough.

Figure 3:
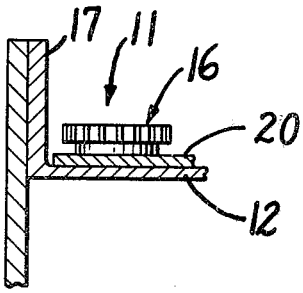
FIG. 3 is an enlarged diagrammatic and fragmentary cross sectional view of an embodiment of the invention adding a protective plate to the gutter or channel of FIG. 2.
Figure 4:
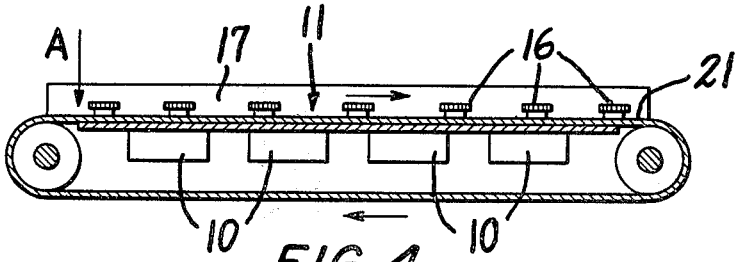
FIG. 4 is a diagrammatic cross sectional view of an embodiment of the invention adding an endless conveyor for moving parts as they are cleaned.

Substantial wearing of the plate can occur both by the sliding of the parts 16 and by cavitation. Therefore, in some cases, an easily replaceable additional plate or member 20 protecting the bottom of the gutter can be added as shown in FIG. 3. With the addition of the plate 20, however, transmission losses of the ultrasonic energy increase. In a further embodiment of the invention, the extra plate can be an endless metal conveyor 21 as generally, schematically shown in FIG. 4. With this arrangement, the conveyor preferably moves the parts horizontally through the liquid bath.

Figure 5:
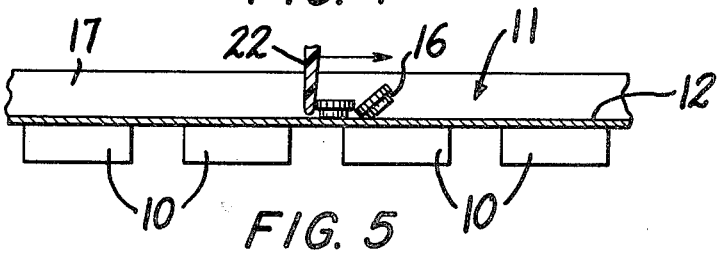
FIG. 5 is another enlarged cross section of an embodiment of the invention diagrammatically illustrating a wiper arrangement for moving parts along the vibratory plate.
Figure 6:
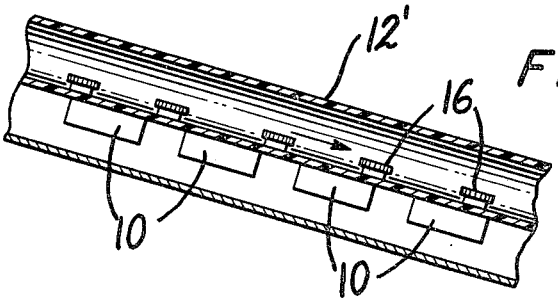
FIG. 6 is a further enlarged cross sectional view of an embodiment wherein the vibratory plate is in the form of a pipe through which the parts move.

In yet another arrangement according to the invention, as illustrated in FIG. 5, the plate or plates can be located horizontally in a liquid bath, and the parts can be transported thereon by the use of a scraper 22. Although the plate 12 that applies the ultrasonic vibration to the parts is preferably made of metal, it is possible to employ nonmetallic materials, for example layers of plastic materials. The plate need not be planar, but may be configured as is suitable for the particular parts to be treated. For example, in one embodiment, the gutter can be made of corrugated sheet. In another embodiment the plate constitutes a pipe 12' of, for example, plastic, and this is very generally illustrated in FIG. 6. In this context then, the word "plate", or "member," means, broadly, a part, whether of metal or nonmetallic material, having a surface available for ultrasonic energization, and another for imparting ultrasonic energy therefrom.

On cleaning metal parts, there is often a need to remove a layer or flakes of oxides, for instance in the production of screws, nuts, and bolts. Ultrasonic cleaning according to the invention is then preferably combined with a pretreatment using pickling for a short period of time in a suitable acid bath. As an alternative, the liquid bath 13 in which the ultrasonic cleaning takes place can be a weak acid pickling bath.

Because of the mechanical contact between the generator and the parts to be cleaned, via the plate 12 or plates 12 and 20, a much faster and more efficient cleaning is achieved than in previously known equipment where ultrasonic energy is directed to the parts through the bath. The short treatment time and the comparatively low amount of energy that is required from the ultrasonic generator in order to achieve an efficient cleaning reduces the risk for cavitation damage to the equipment and to the parts being cleaned. In addition, an advantage of using an ultrasonic cleaning method according to the invention is high cleaning efficiency achieved at lower energy input and shorter treatment time.

Figure 7:
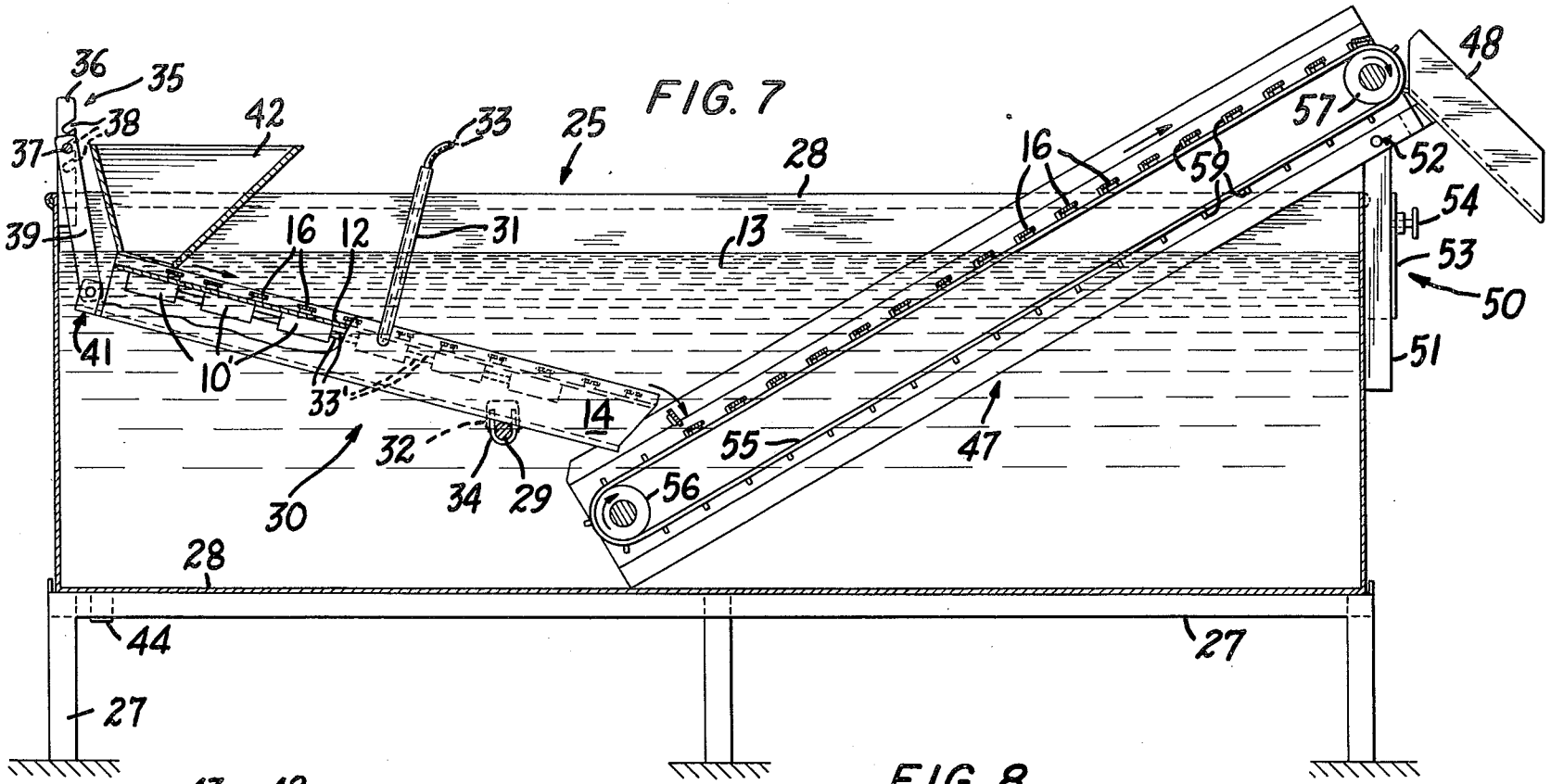
FIG. 7 is a cross sectional view of a further embodiment of the invention illustrating a specific means for adjusting the inclination of the vibratory plate along which the parts move and the addition of a further conveying system for removing parts from the bath.
Figure 8:
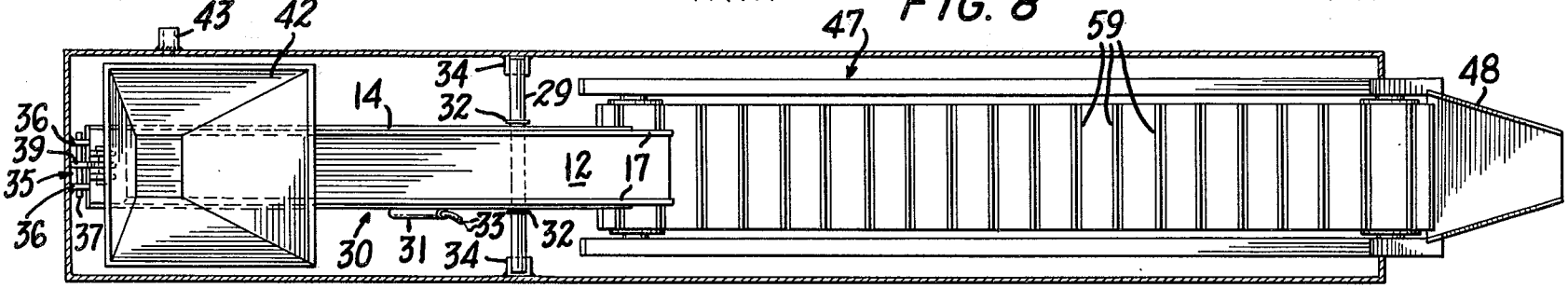
FIG. 8 is a top view of the cleaning apparatus of FIG. 7 and further illustrates the arrangement of the inclined vibrating plate and part-removal conveyor in the bath.

FIGS. 7 and 8 illustrate in greater detail a preferred embodiment wherein the general features of the invention set forth above are incorporated. This cleaning apparatus is a relatively large scale assembly suitable for permanent installation and relatively high production cleaning of parts coming off an assembly line, for example. The apparatus, generally designated 25, is supported on a frame 27 constructed and arranged to support a tank 28. The tank 28 contains water or a suitably chosen cleansing or pickling agent and thereby forms the bath 13 referred to above. Ultrasonic transducers 10' are shown affixed to the plate 12 described above along which workpieces 16 move. Piezoelectric transducers are preferred. The transducers 10' are housed in the shell 14, and suitably chosen liquid-tight connections and conduit 31 house electrical leads 33 that connect with the transducers 10' to energize the same. The transducers 10' can be energized by an alternating electrical potential at a chosen ultrasonic frequency. The transducers can be individually energized or interconnected as shown by leads 33'. The transducers 10', plate 12, shell 14 and associated hardware and electrical leads 33 and conduit 31 form a subassembly, generally designated 30. This subassembly 30 is supported in the tank by, first, a transverse rod 29 received in U-shaped brackets 34 welded or brazed to the interior of the sides of the tank 28. A pair of tabs 32, one on each side of the shell 14, locates the subassembly 30 on the rod 29. The assembly 30 is pivotal about the rod 29.

Near the input end of the tank 28, an adjustable support means 35 forms one of any number of suitable inclination adjusting means that can be chosen to form the inclination adjusting means that is generally, diagrammatically indicated in FIG. 1. Shown in FIGS. 7 and 8, the adjustable support 35 includes an upright rack 36 affixed to an end wall of the tank 28 by, again, welding, brazing or the like. The rack 36 consists of two upright plates with pairs of aligned and inclined slots 38 at differing heights. A similar plate 39 is pivotally affixed at 41 to the end of the subassembly 30. At its upper end the pivotal plate 39 carries a pin 37 that extends horizontally from each of its sides for registration in one of the pairs of slots 38. To adjust the inclination of the plate 12, then, one slips the pin 37 into the desired slots 38 of the rack 36.

Near the input end of the vibratory plate 12 an input funnel 42 extends below the level of the liquid of the bath 13 to proximate the upper surface of the vibratory plate 12. Other suitable feed arrangements for placing and workpieces or parts onto the plate 12 can be tailored to particular needs. In the illustrated embodiment, the parts or workpieces 16 can be fed into the funnel 42 and onto the plate 12 from an aligned conveyor leading directly from an automated production line, for example. Also at the input end of the cleaning apparatus 25 a filling connection 43 communicates with the bath 13 through a side of the tank 28. Likewise through the bottom of the tank 28 a drainage connection 44 is conveniently located.

In the embodiment shown in FIGS. 7 and 8, removal of the cleaned parts occurs automatically. An aligned conveyor 47 extends between the output end of the vibratory plate 12 and an aligned chute 48. The chute 48 is suitably supported at the farther end of the tank to direct the parts 16, dropping from the conveyor 47, to a collection container or, for example a further conveyor.

The conveyor 47 is connected with the tank 28 at the end wall of the tank remote from the assembly 30. For example, an adjustable arrangement 50 including a vertically movable upright support 51 pivotally connected at 52 to the conveyor can be clamped at a desired height by a clamping member 53 manually tightened by threaded adjusting means 54. The conveyor 47 can be of the kind wherein an endless belt 55 is entrained about gears or rolls 56 and 57, one of which is driven from a suitably chosen drive means or motor, not shown but known in the art. Preferably the belt 55 includes spaced transverse ridges or ribs 59 assuring uphill movement of the workpieces 16. The conveyor 47 can, in fact, be a suitably chosen commercially available assembly.

In operation, the workpieces 16 are dropped into the funnel 42 and onto the vibratory plate 16. Depending on the amount of cleaning necessary, the adjustable support 35 has been arranged to provide the correct degree of inclination to the plate 12 whereby the workpieces 16 move slowly or quickly down the vibratory surface of the plate. As they reach the end of the plate 12, the workpieces 16 drop onto the conveyor 47 and are transported by the conveyor 47 to the chute 48. There they leave the apparatus 25 and are taken to an assembling or packing station, for example. By virtue of combining the movement of the workpieces with the ultrasonic cleaning directly from the vibratory plate 12, no tedious timing of individual workpieces is required, but each proceeds through the bath 13 in the requisite time.

Figure 9:
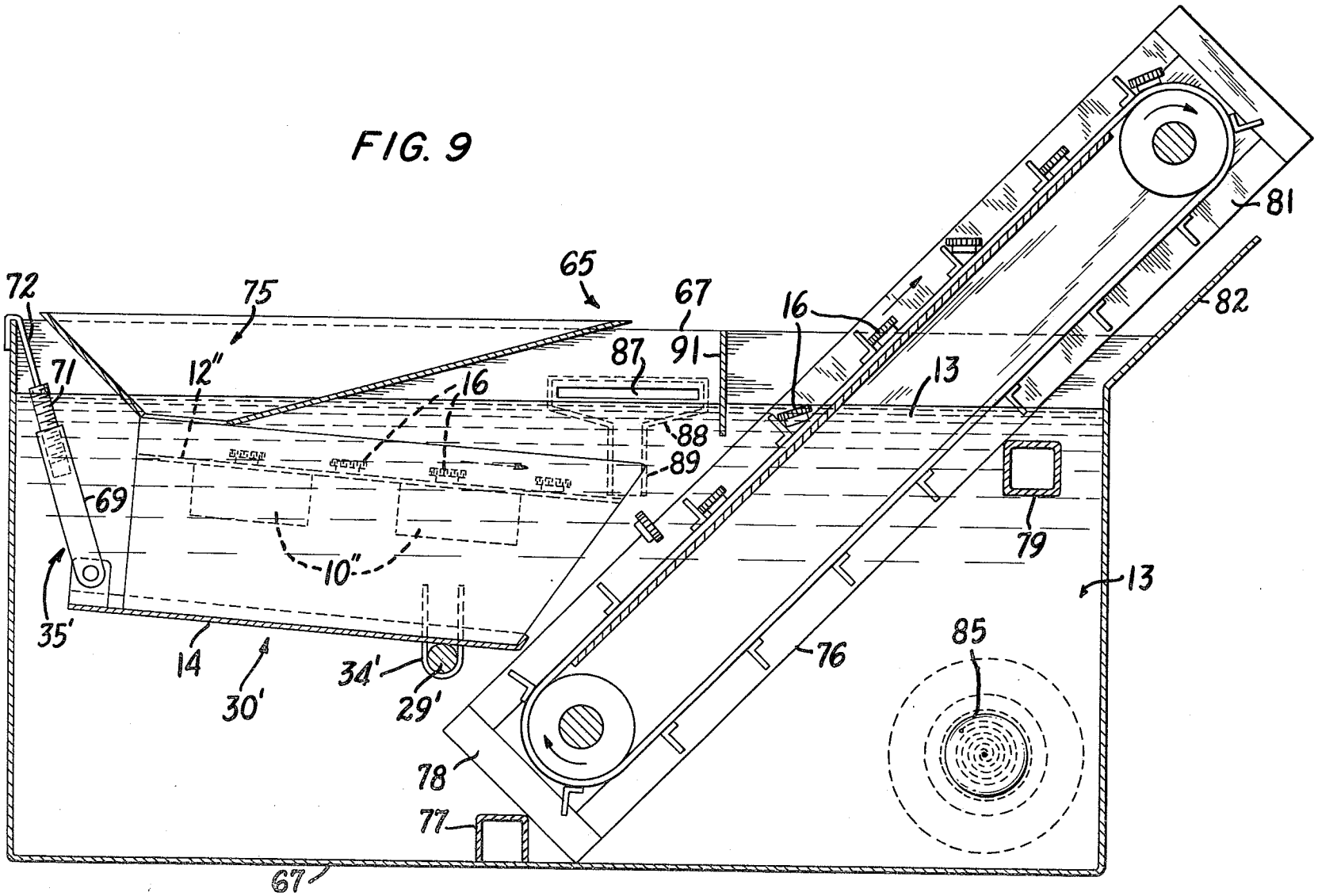
FIG. 9 is a cross sectional view of a smaller vibrator and bath with heater, part-removal conveyor, inclination adjusting means, and an enlarged feeding funnel.

Another embodiment of the invention illustrates this invention's versatility and adaptability. A much smaller, yet automatic vibratory cleaning apparatus 65 is shown in FIG. 9. The tank 67 that forms the bath 13 is much smaller that the apparatus of FIGS. 7 and 8, totaling, for example, 460 cm. in length. The apparatus 65 is ideally suited for individual use at a workbench or lab bench wherein parts are dropped in place following a hand operation. A subassembly 30' again includes one or more of the individual transducers 10'' and a plate 12'' shorter in length than that described in connection with FIGS. 7 and 8, but similarly pivotally supported by a transverse rod 29' and brackets 34'. Electrical connections to the generators can be provided as illustrated for the apparatus of FIGS. 7 and 8. An adjustable support 35' permits adjustment of the inclination of the plate 12'' to establish the rate of movement of parts 16 along the plate 12''. Pivotally connected with subassembly 30' is an internally threaded member 69. An externally threaded member 71 terminates in a hook 72 that engages the rim of the tank end wall. To modify the inclination of the plate 12'', one screws the member 71 more or less deeply into the internally threaded member 69.

Hand delivery of parts to the vibratory plate 12'' is facilitated by a funnel 75 whose wide upper opening covers the entire length, or almost the entire length, of the vibratory plate 12'' and extends across the width of the bath. At its smaller, lower open end, the funnel 75 delivers the parts 16 to the upstream end of the vibratory plate 12''. A worker feeding parts to the funnel 75 will be able to do so quickly and without concern for placement near the input end of the plate; few if any parts will miss the funnel and the worker's attention can remain on his task.

At the downhill end of the plate 16, a conveyor 76 communicates between the plate and the output end of the apparatus. Again, the conveyor can be a commercially available unit or an especially designed conveyor. The conveyor 76 is positioned in the bath 13 in any convenient way. As shown, a transverse frame member 77 affixed to the bottom of the tank 67 engages a frame member 78 of the conveyor to establish the position of the downstream conveyor end within the bath. Likewise, a support member 79 is shown engaging the upper, output end of the conveyor at a frame member 81. Beneath the upper end of the conveyor 76, where it emerges from the bath 13, the tank 67 is formed with an uplifted skirt 82 that reduces splashing and dripping from the conveyor.

Generally indicated at the lower righthand corner of the bath 13 is a heater 85. This is a suitably chosen commercial heater for raising the temperature of the bath in cleaning operations when that is desired. Likewise in any embodiment of this invention, a heater can be installed if the cleaning calls for increased bath temperature.

In a side of the tank 67 an overflow opening 87 is provided at the desired liquid level. An output connection 88 is affixed to the outside of the tank 67 in communication with the opening 87. The connection 88 terminates in a pipe-like end 89 suitable for connection to a hose or the like. The skirt 82 and the overflow provisions can be used in the embodiment illustrated in FIGS. 7 and 8, as well. Like the skirt 82, the overflow provisions contribute to the smaller embodiment's use at a workbench or individual work site without troublesome spilling of liquid from the bath.

A transverse plate-like barrier 91 spans the width of the tank 67 at the liquid surface level. Oils, for example, cleansed from the parts 16, float to the surface. The barrier 91 prevents these from spreading to where the conveyor emerges from the bath. This prevents the parts 16 carried out of the bath on the conveyor 76 being lifted through a film of oil and being re-wetted by the oil that was previously removed. Locating the overflow opening 87 on the same side of the barrier 91 as the subassembly 30' permits the removal of oil at the bath surface. Of course, this arrangement can be provided in the larger embodiment of FIGS. 7 and 8 also.

The embodiment illustrated in FIG. 9 has the advantage of freeing a worker from timing the vibratory cleaning of parts, by controlling the time during which the parts are in the bath 13. The worker thus is freed to direct his full attention to whatever operation he performs as he drops parts 16 into the funnel 75. Moreover, the worker cannot err by leaving the parts in the bath too long; so corrosion losses can be reduced.

The versatility of the invention is demonstrated by the several embodiments set forth above. The direct application of vibratory energy to the parts by their resting on the plate 12 as they move enhances cleaning, shortens cleaning time, reduces input electrical energy necessary to drive the transducers, and thus results in a much improved cleaning device.

The foregoing details of specific embodiments are illustrative only. The foregoing description of preferred embodiments is not to be construed as limiting the scope of protection of the invention, which scope is set forth in the appended claims.

We claim:

1. The method of cleaning articles including the steps of:

(a) placing the articles in mechanical contact with a flat plate member disposed in a liquid bath, (b) applying ultrasonic vibratory energy to the articles from the member by energizing an ultrasonic transducer in direct mechanical contact with the plate, and (c) conveying the articles in the bath during their mechanical contact with the member and during the application of the vibratory energy.

2. The method according to claim 1, further including controlling the time of the application of the ultrasonic vibratory energy by adjusting the rate of movement of the articles in contact with the member.

3. The method of claim 1 further comprising the step of confining floating contaminants removed from the articles, and said step of conveying includes removing the articles from the bath at a location away from the location where the floating contaminants are confined, whereby articles are not recontaminated by contact with the floating contaminants.

4. The method according to claim 1, wherein the step of conveying comprises moving a wiper across the surface of the vibratory member in engagement with the articles.

5. A method of cleaning articles including the steps of:

(a) placing the articles in mechanical contact with a member disposed in a liquid bath, (b) applying ultrasonic vibratory energy to the articles from the member, and (c) conveying the articles in the bath during their mechanical contact with the member and during the application of the vibratory energy, the step of conveying including (1) inclining the member, (2) vibrating the member with at least one ultrasonic vibration generating transducer coupled thereto, and (3) disposing the articles on the member at an elevated end, whereby the articles move downhill on the member in direct mechanical contact therewith as the member vibrates.

6. The method according to claim 5 further comprising directing the articles from the member to an automatic removal means and automatically removing the articles from the bath.

7. A method of cleaning articles including the steps of:

(a) placing the articles in mechanical contact with a member disposed in a liquid bath, (b) applying ultrasonic vibratory energy to the articles from the member, and (c) conveying the articles in the bath during their mechanical contact with the member and during the application of the vibratory energy, the vibratory member being the endless belt of a conveyor and the step of conveying including moving the articles on the endless belt conveyor while applying ultrasonic vibratory energy to the endless belt.

8. A method of cleaning articles including the steps of:

(a) placing the articles in mechanical contact with a member disposed in a liquid bath, (b) applying ultrasonic vibratory energy to the articles from the member, and (c) conveying the articles in the bath during their mechanical contact with the member and during the application of the vibratory energy, the member being an inclined, elongate, thin plate, the steps of applying ultrasonic vibratory energy comprising vibrating the plate by energizing a series of ultrasonic transducers located beneath the plate and housed in liquid-tight enclosure means beneath the plate, said step of placing the articles comprising depositing the articles on the plate near one uphill end thereof, and said step of conveying comprising confining the articles to the plate from the location at which the articles are deposited and causing the articles to slide down the plate while vibrating the plate ultrasonically until the articles drop from the downhill end of the plate.

9. Ultrasonic vibratory cleaning apparatus including:

(a) means for containing a bath, (b) a vibratory flat plate member located at least partly in said bath containing means and including a flat surface for supporting articles to be cleaned, and (c) ultrasonic vibration generating transducer means directly mechanically coupled to said vibratory member for applying ultrasonic vibratory energy to the vibrating member.

10. The ultrasonic vibratory cleaning apparatus according to claim 9, wherein said transducer means includes plural ultrasonic transducers mechanically coupled to said vibratory member.

11. The ultrasonic vibratory cleaning apparatus according to claim 9 further comprising means for moving articles supported on said surface of said vibratory member.

12. The ultrasonic vibratory cleaning apparatus according to claim 11, wherein the means for moving comprises a wiper movable along said surface for engagement with articles thereon.

13. The ultrasonic vibratory cleaning apparatus according to claim 11 further comprising means for directing articles to be cleaned to a first location on said surface for movement by said means for moving on said surface to a second location.

14. Ultrasonic vibratory cleaning apparatus including:

(a) means for containing a bath, (b) a vibratory member located at least partly in said bath containing means and including a surface for supporting articles to be cleaned, (c) ultrasonic vibration generating transducer means mechanically coupled to said vibratory member for applying ultrasonic vibratory energy to the vibratory member, and (d) means for moving articles supported on said surface of said vibratory member, the means for moving articles including means for supporting the vibratory member at an angle of inclination to cause the supported articles to move downhill on said surface as ultrasonic vibratory energy is applied thereto directly from the vibratory member.

15. The ultrasonic vibratory cleaning apparatus according to claim 14, wherein the means supporting the vibratory member includes means for adjusting the inclination of the vibratory member, thereby to control the rate of movement of articles on said surface.

16. The ultrasonic vibratory cleaning apparatus according to claim 14, wherein said vibratory member comprises a pipe coupled to said transducer means.

17. Ultrasonic vibratory cleaning apparatus including:

(a) means for containing a bath, (b) a vibratory member located at least partly in said bath containing means and including a surface for supporting articles to be cleaned, (c) ultrasonic vibration generating transducer means mechanically coupled to said vibratory member for applying ultrasonic vibratory energy to the vibratory member, and (d) means for moving articles supported on said surface of said vibratory means, the means for moving comprising and endless belt conveyor, said vibratory member comprising the endless belt of the conveyor.

18. Ultrasonic vibratory cleaning apparatus including:

(a) means for containing a bath, (b) a vibratory member located at least partly in said bath containing means and including a surface for supporting articles to be cleaned, (c) ultrasonic vibration generating transducer means mechanically coupled to said vibratory member for applying ultrasonic vibratory energy to the vibratory member, (d) means for moving articles supported on said surface of said vibratory member, and (e) means for directing articles to be cleaned to a first location on said surface for movement by said means for moving on said surface to a second location, the means for directing articles to a first location on said surface comprising a funnel located proximate one end of the means for containing a bath with an upper end for receiving articles and a lower, smaller end located proximate the first location on the surface to deposit articles at the first location.

19. The ultrasonic vibratory cleaning apparatus according to claim 18, wherein the upper funnel end covers substantially the entire area of the surface for supporting articles, whereby hand delivery of articles accurately to the surface is facilitated.

20. Ultrasonic vibratory cleaning apparatus including:

(a) means for containing a bath, (b) a vibratory member located at least partly in said bath containing means and including a surface for supporting articles to cleaned, and (c) ultrasonic vibration generating transducer means mechanically coupled to said vibratory member for applying ultrasonic vibratory energy to the vibratory member, said surface for supporting the articles being located in an inclined gutter, said gutter comprising the upper portion of a liquid-tight housing, said transducer means including a plurality of ultrasonic vibration generating transducers located in said housing and directly coupled to a bottom surface of said gutter for imparting vibratory energy to said articles through said bottom surface to the articles.

21. Ultrasonic vibratory cleaning apparatus including:

(a) means for containing a bath, (b) a vibratory member located at least partly in said bath containing means and including a surface for supporting articles to be cleaned, and (c) ultrasonic vibration generating transducer means mechanically coupled to said vibratory member for applying ultrasonic vibratory energy to the vibratory member, said vibratory member comprising a replaceable protective layer the upper surface of which is the surface for supporting the articles, and said transducer means comprising at least one transducer coupled to a thin plate supporting the protective layer.

22. An assembly for use in a cleaning bath to impart ultrasonic cleaning vibrations to articles, the assembly including a liquid-tight housing, an upper portion of the housing including a thin vibratory plate, at least one ultrasonic vibration generating transducer in said housing directly, mechanically coupled to said plate, the plate being in direct mechanical vibratory driving relation to an article support surface for supporting articles to be cleaned, and means connected with said housing and plate and cooperating with said plate for causing movement of individual articles along the support surface from proximate one end of the assembly to the other end thereof, whereby the time of direct application of ultrasonic vibratory energy to articles on the support surface is controlled by the speed of movement of the articles thereon caused by the means for causing movement.

* * * * *

UNITED STATES PATENT AND TRADEMARK OFFICE

CERTIFICATE OF CORRECTION

PATENT NO. : 4,194,922

DATED : March 25, 1980

INVENTOR(S) : Åke Gransell; Sven A. Jansson, Malte Sporrong

It is certified that error appears in the above-identified patent and that said Letters Patent are hereby corrected as shown below:

Col. 3, line 16, "the enclosure" should read --their enclosure--;

Col. 5, line 55, "that" should read --than--;

Col. 9, line 31, "and" should read --an--; and

Col. 10, line 11, after "to" insert --be--.

Signed and Sealed this

*Twelfth* Day of *August 1980*

[SEAL]

*Attest:*

SIDNEY A. DIAMOND

*Attesting Officer*

*Commissioner of Patents and Trademarks*